US005678797A

United States Patent [19]

Gogan

[11] Patent Number: 5,678,797

[45] Date of Patent: Oct. 21, 1997

[54] FLUSH-MOUNT SUPPORT BRACKET

[75] Inventor: James M. Gogan, Brick, N.J.

[73] Assignee: Kinetron Incorporated, Ocean, N.J.

[21] Appl. No.: 511,680

[22] Filed: Aug. 7, 1995

[51] Int. Cl.[6] ..... A47H 1/14

[52] U.S. Cl. ..... 248/251; 248/300; 211/183; 312/348.5

[58] Field of Search ..... 248/250, 251, 248/300, 228.1, 228.7, 229.1, 229.16, 214; 211/46, 183; 312/184, 193, 348.3, 348.5, 321

[56] References Cited

U.S. PATENT DOCUMENTS

| | | | |
|---|---|---|---|
| 1,049,900 | 1/1913 | Mowins | 248/300 X |
| 1,235,476 | 7/1917 | Hoff | 248/251 |
| 1,582,363 | 4/1926 | Wheary | 312/321 |
| 1,657,243 | 1/1928 | Daniels | 248/300 X |
| 2,144,804 | 1/1939 | Irwin et al. | 211/184 X |
| 2,435,288 | 2/1948 | Nisenson . | |
| 2,530,892 | 11/1950 | Mayo | 248/300 X |
| 2,709,494 | 5/1955 | Luce | 248/300 X |
| 2,873,091 | 2/1959 | Kinsman | 248/300 X |
| 3,278,149 | 10/1966 | Brucker | 248/251 X |
| 3,675,883 | 7/1972 | Holmes et al. . | |
| 3,858,837 | 1/1975 | Merritt . | |
| 4,219,247 | 8/1980 | Litchfield et al. . | |
| 4,768,661 | 9/1988 | Pfeifer | 211/184 |
| 4,913,392 | 4/1990 | Swartzendruber . | |
| 4,988,006 | 1/1991 | Lundin . | |
| 5,004,369 | 4/1991 | Young | 411/399 X |

*Primary Examiner*—Korie Chan
*Attorney, Agent, or Firm*—Howson and Howson

[57] ABSTRACT

A flush-mount bracket for supporting the end of a rail from on which file folders may hang in a cabinet or desk drawer. One embodiment includes a U-shaped clamp with legs having smooth interfaces for ease of mounting over the top edge of a drawer panel and for providing vertical and lateral support to the rail. Other embodiments describe alternate means for securing the bracket to support structure.

13 Claims, 3 Drawing Sheets

FLUSH-MOUNT SUPPORT BRACKET

SUMMARY OF THE INVENTION

The present invention relates generally to support structure for hanging pocket-type file folders in cabinet and desk drawers, and more particularly to novel and improved flush-mount brackets for supporting guide rails in cabinet and desk drawers on which the file folders are suspended.

A convenient arrangement for partitioning and storing records and documents in a cabinet and desk drawer utilizes flexible pocket-type hanging file folders. Each folder is typically folded into halves and hung with the opening formed thereby at the top by hooks extending from opposite corners of each half. In desks and custom furniture, the hooks slide on a pair of parallel steel or aluminum rods or guide rails supported between slots or notches normally milled in opposite side and end panels of wooden drawers by the original equipment manufacturer. The spacing between the slots or notches allows the customer to install rails either between the side panels for hanging letter-size folders or between the end panels for wider folders. The added labor involved for milling the slots unfortunately adds to consumers' cost.

Some cabinet and desk drawers are furnished with no guide rail supports, even though the drawers have sufficient depth for complete suspension of the folders. To accommodate hanging folders in these instances, the customers may appropriately notch the drawer panels using less precise tools and methods in order to accommodate the rail ends. Without the proper tools and skills, of course, a poor-fitting rail support results.

In lieu of drawer slots or notches made by the manufacturer or customer, several configurations of rail support brackets suitable for installation on new or existing drawer structures have been commercially available. These brackets typically fit over the side or end panels of the drawer and are secured by screws or by acute edges biting into the panel surface. Consequently, they are difficult to install or reposition without risk of permanently damaging or scratching the drawer surfaces, particularly those of soft wood construction.

Accordingly, it is an object of the present invention to provide an improved flush-mount bracket for supporting an end of a rail on which file folders can be suspended in a cabinet or desk drawer.

Another object is to provide a support bracket which can be easily installed in a new or existing cabinet or desk drawer at different positions without structural modifications.

Still another object is to provide a novel and improved flush-mount support bracket which eliminates the need for milling a slot in wooden drawer frames to accommodate the ends of a guide rail from which file folders may depend.

A further object is to provide brackets which will support rails in a drawer for hanging file folders, and which can be readily repositioned or removed without permanent damage or marring of the drawer surface.

Briefly, these objects and other aspects of the invention are accomplished with a support bracket which flush mounts on support structure in a cabinet or desk drawer for supporting one end of a rail or rails on which hanging file folders can be accommodated. One embodiment defines a generally U-shaped clamp of a stiff sheet or strip of metal with parallel legs extending perpendicularly from a web section for gripping the opposite interior and exterior surfaces of a drawer panel. The distal end of the interior leg terminates in a flange or shelf projecting outwardly for vertically supporting the rail end. Lateral support is provided by a pair of L-shape members which are received in a slot in the inner leg extending from the shelf to the web section. Like arms of the members project outwardly above the shelf and are spaced apart, in parallel relationship to each other, against opposite sides of the slot to engage the sides of the rail. Proximal ends of the arms are fixed, respectively, on either side of the slot to the surfaces of the interior leg facing the exterior leg. The mutually facing surfaces of the members and exterior leg are smooth and spaced apart to provide a flush and snug fit against the side or end panel of the drawer. The smooth surfaces allow ease of positioning and ensure against scratching the drawer panel. Other embodiments of the invention include several configurations for fixing the support bracket to side or top of the drawer panel, and for supporting the ends of two oppositely extending guide rails on a single drawer divider panel or bar.

For a better understanding of the invention, reference will be made to the following detailed description taken in conjunction with the accompanying drawings.

DESCRIPTION OF HE PREFERRED EMBODIMENTS

Figure 1:
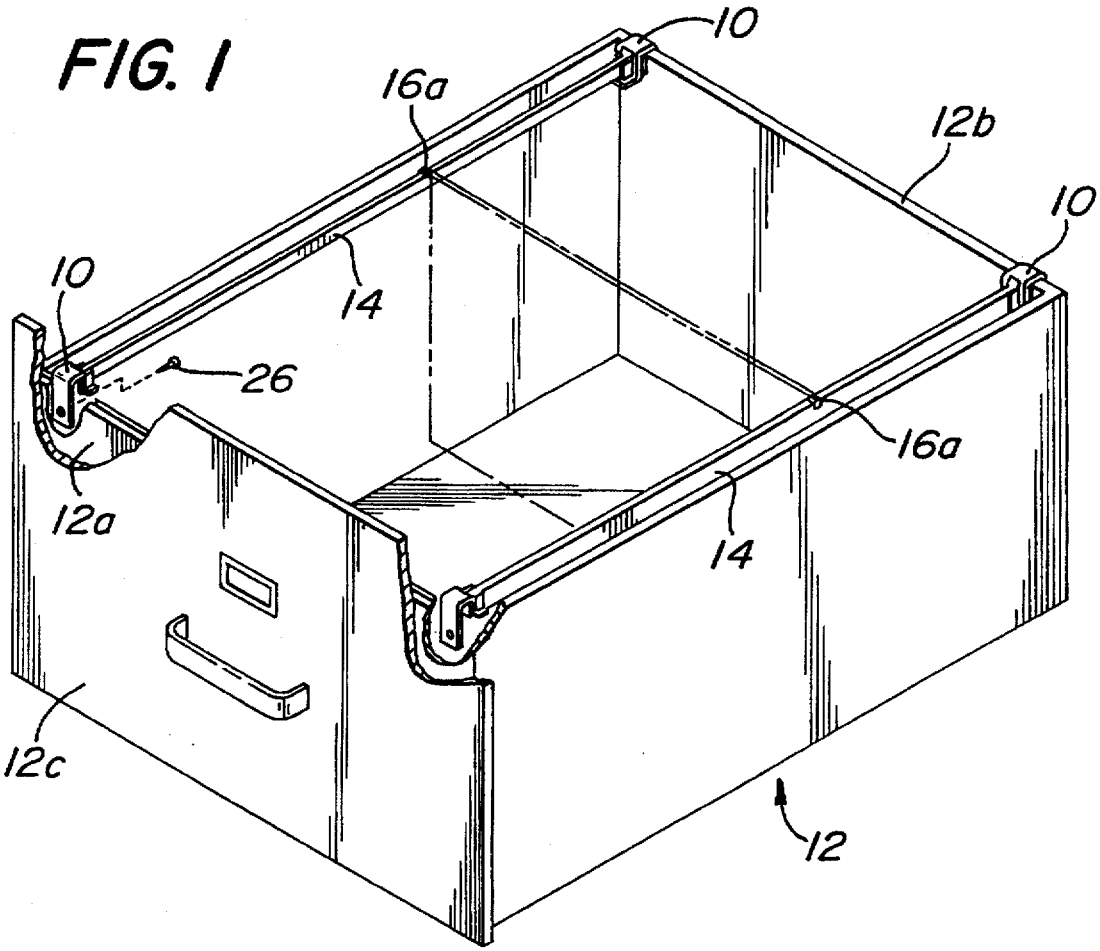
FIG. 1 is an isometric view of support brackets according to one embodiment of the invention, with installed rails in a partially cut-away file drawer suitable for hanging folders.

Referring now to the drawings wherein like-referenced characters denote like or corresponding parts throughout the several views, there is illustrated in FIG. 1 one embodiment according to the invention of four flush-mount support brackets 10 installed in opposed pairs on front and back panels **12*a* and 12*b* of a wooden cabinet drawer 12, each pair engaging the opposite ends of metal guide rails 14, typically of steel or aluminum. A fascia 12*c*, with a handle and card holder, is fixed in spaced relation to front panel 12*a* thereby allowing brackets 10 to be fitted in the space provided. The brackets 10 are suitably spaced along each panel to position rails 14 in parallel for hanging file folders or similar articles therebetween. A typical pocket-type folder 16, shown in broken outline, is suspended from rails 14 by four hooks 16*a* which extend from the upper corners of the folder halves and slide along rails 14**.

Figure 2:
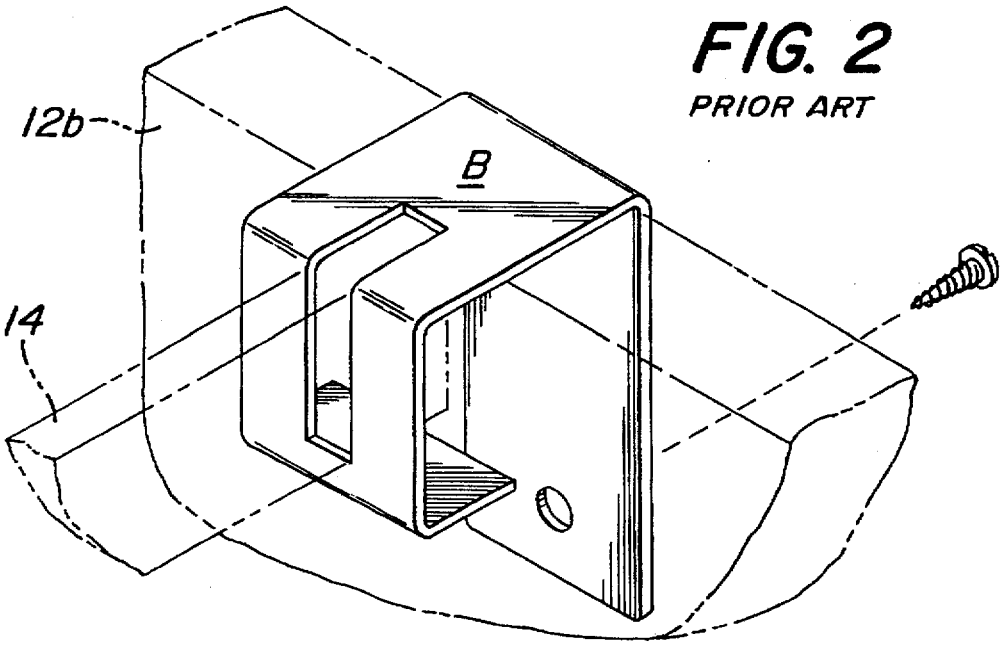
FIG. 2 PRIOR ART
FIG. 2 is an isometric view of a prior art bracket.

Previous designs have produced brackets for hanging folder guide rails which are difficult to install and often damage the drawer panels. For example, FIG. 2 shows a generally U-shaped bracket B which is similar to bracket 10 insofar as it provides vertical and lateral support to the end of rail 14. A smooth surface on one leg presses against the exterior surface of a drawer panel 12*b*, but an acute edge projects inwardly from the other leg and presses against the opposite interior surface of the panel. The compression force exerted by the projection helps to prevent the bracket from dislodging or shifting, but makes the bracket more difficult to install or remove and increases the risk of permanent damage to the drawer surfaces, especially if the drawers are made of wood.

Bracket 10, on the other hand, has smooth surfaces which grip tightly about the top edges of the front and rear drawer panels, but nevertheless are easy to install and remove without risk of damaging the panels. As better illustrated in FIGS. 3 and 4, flush-mount support bracket 10 is shown installed on rear drawer panel 12*b* with a fragment of rail 14 juxtaposed for insertion in the direction of arrow A. Bracket 10 defines a generally U-shaped clamp 18 of stiff sheet or strip metal with parallel legs 18*a* and 18*b*, respectively, extending perpendicularly from a upright web section 18*c*. The distal end of leg 18*a* terminates in a shelf 18*d* extending outwardly relative to leg 18*b* for supporting rail 14 against vertical downward movement.

Rail 14 is confined laterally by a pair of metal L-shaped members 20 having parallel spaced arms 20*a* extending nearly the full length of leg 18*a* and projecting outwardly on shelf 18*d* through a slot 24. Arms 20*a* abut the respective opposite sides of slot 24 with orthogonal flanges 20*b*, fixed by spot welds to respective inside surfaces of the leg 18*a* at either side of slot 24. The mutually facing surfaces of flanges 20*b* and outer leg 18*b* are smooth and separated a distance sufficient to provide a flush and snug fit against the interior and exterior surfaces of panel 12*b*, typically ½", 5/8" and ¾" thick. The smooth surfaces allow the brackets to be easily installed and positioned without scratching the surface of the drawer panel.

Although not an essential to this embodiment, but to satisfy customer preferences, a hole 25 near the distal end of outer leg 18*b* provides for optionally reinforcing the placement of bracket 10 to panel 12*b* by a relatively minimally invasive screw fastener 26. When brackets 10 are installed between fascia 12*c* and front panel 12*a* they may be secured by extending fastener 26 through panel 12*a* until it is threaded into hole 25.

Figure 4:
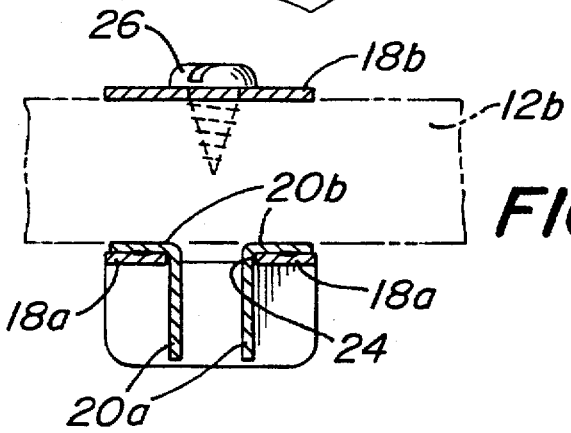
FIG. 4 is an isometric view of one of the support bracket of FIG. 3 taken on plane 4—4 thereof.
Figure 6:
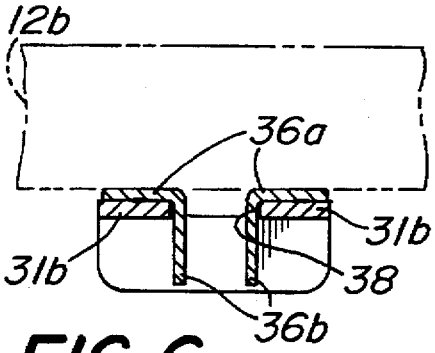
FIG. 6 is a view in cross section of the support bracket of FIG, 3 taken on plane 6—6 thereof.
Figure 5:
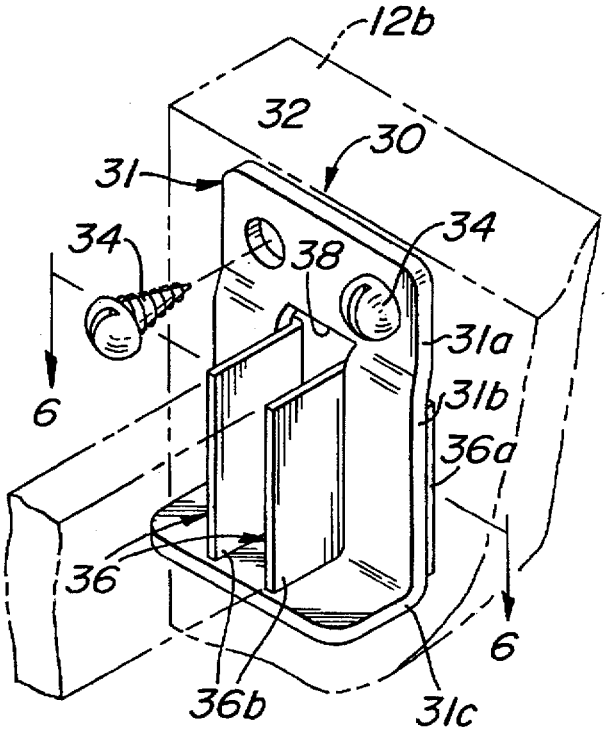
FIG. 5 is an isometric view of still another embodiment of a support bracket according to the invention for fastening to the upper edge of a wooden end or side panel of a drawer.

Referring to FIGS. 5 and 6, there is shown another embodiment of a flush-mount support bracket 30 according to the invention suitable for fastening to the interior surface of drawer panel 12*b* to avoid interference along the top edge. Bracket 30 is defined by a generally rectangular sheet or strip metal plate 31 which is secured by relatively small fasteners 34 screwed into the interior surface of drawer panel 12*b* through holes 32 located in an upper section 31*a*. A lower section 31*b* terminates in a shelf 31*c* extending generally perpendicular thereto for vertically supporting a rail 14. Lateral containment of rail 14 is provided by L-shaped members 36 with flanges 36*a* spot-welded to the side of plate 31 facing panel 12*b*, and parallel spaced arms 36*b* projecting outwardly through a slot 38 in the manner above-described for members 20 in FIGS. 3 and 4. Lower section 31*b* on either side of slot 38 are offset outwardly from upper section 31*a* an amount equal to the thickness of flanges 36*a* in order that the panel-facing surfaces of upper section 31*a* and flanges 36*a* will flush-mount against drawer panel 12*b*.

Figure 7:
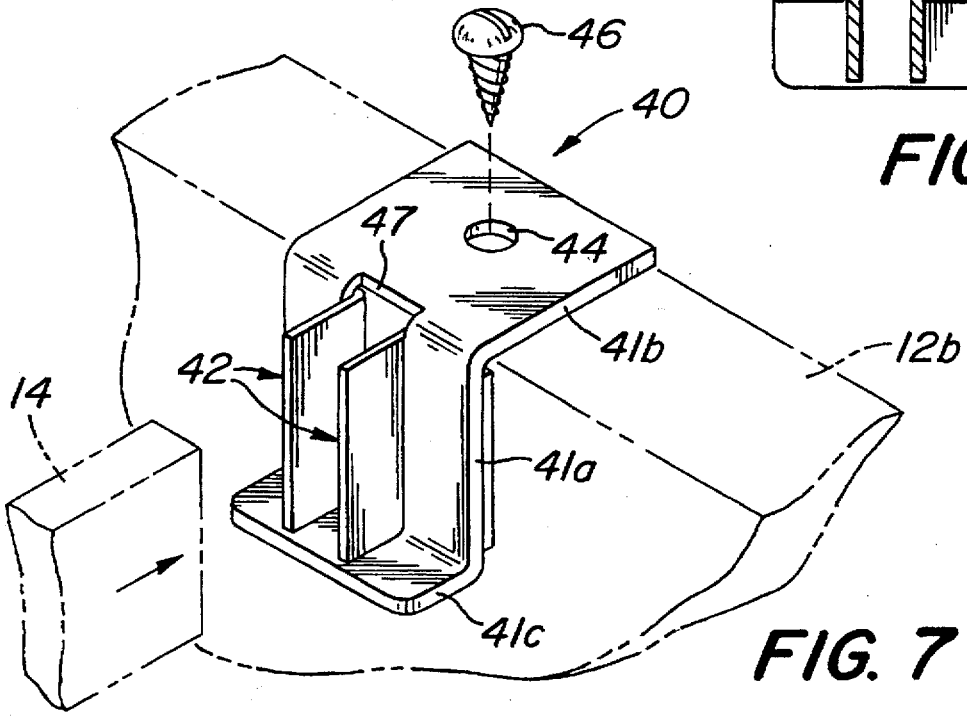
FIG. 7 is an isometric view of still another embodiment of a support bracket according to the invention for fastening to the interior surface of a drawer side or end panel.

FIG. 7, illustrates another embodiment of a rail support bracket 40 suitable for fastening to the upper edge of a drawer panel. Bracket 40 differs from bracket 10 of FIGS. 3 and 4 by the absence of a leg pressing against the external side of the drawer panel. Instead, bracket 40 includes a sheet metal section 41*a* with a generally perpendicular flange 41*b* extending over the upper edge of drawer panel 12*b*. It is secured by a relatively small screw 46 threaded into the top surface of drawer panel 12*b* through a hole 44 in flange 41*b*. The lower end of section 41*a* terminates in a shelf 41*c* to provide vertical support to rail 14. L-shaped members 42 project through a slot 47 in plate 40*a* to provide lateral support to rail 14. In other respects shelf 41*c* and L-shaped members 42 are substantially like shelf 10*d* and members 20 in FIGS. 3 and 4.

Figure 8:
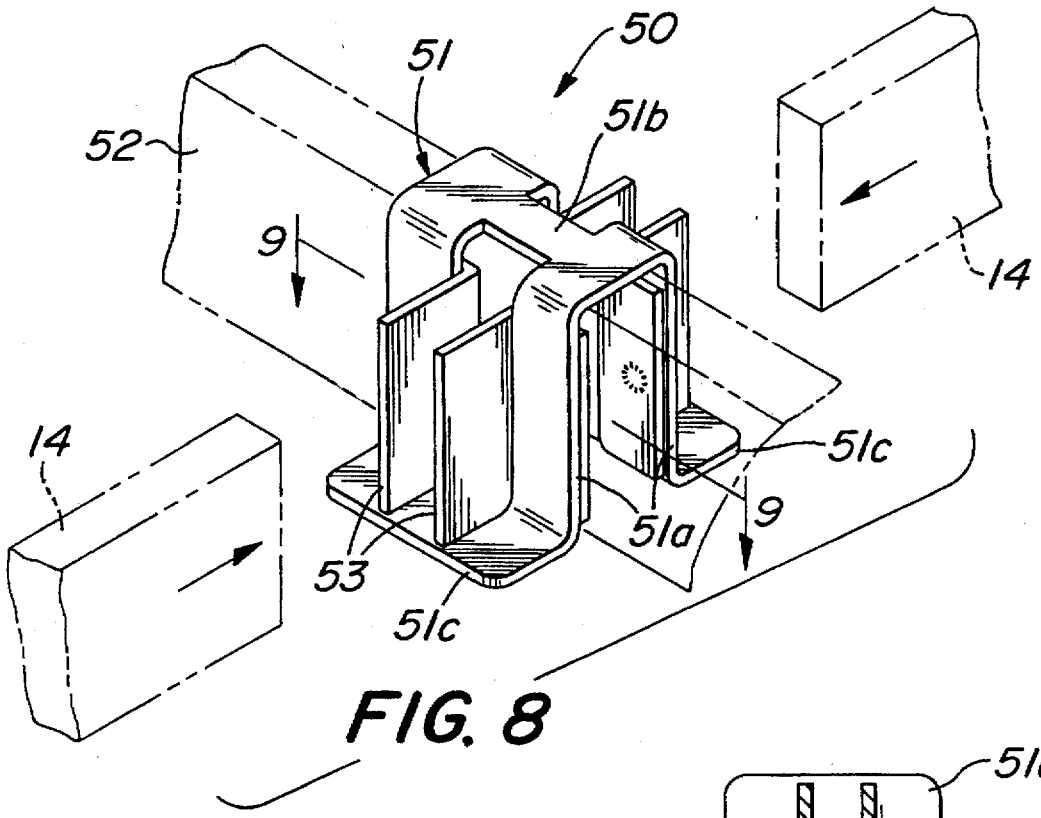
FIG. 8 is an isometric view of yet another embodiment of a support bracket according to the invention for supporting the ends of rails on either side of a dividing panel.
Figure 9:
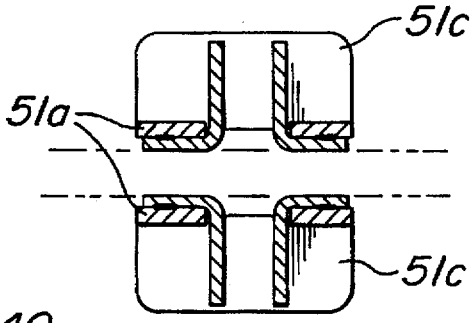
FIG. 9 is a view in cross section of the support bracket of FIG. 8 taken on plane 9—9 thereof.

FIGS. 8 and 9 show a flush-mount bracket 50 suitable for supporting hanging file folders from a divider bar in a cabinet or desk drawer. This arrangement allows the files to hang across the width of the drawer for its entire length. Bracket 50 is defined by a generally inverted U-shaped clamp 51 having legs 51*a* extending in parallel from a web section 51*b* for straddling a divider bar 52 which spans a drawer between its opposite sides. Pairs of parallel rails 14 (only one of each pair being illustrated) extend respectively in opposite directions from divider bar 52 to the front and back panels of the drawer. The rails 14 are supported by two shelves 51*c* integrally extending in opposite directions from the lower ends of legs 51*a*, and lateral support by L-shape members 53. In all other respects, shelves 51*c* and L-shaped members 53 are substantially similar to the corresponding elements in the embodiment of FIGS. 3 and 4.

Some of the many advantages and novel features of the invention should now be readily apparent. For instance, a flush-mount bracket is provided which can be easily installed in a new or existing cabinet or desk drawer to support one end of a guide rail on which file folders are suspended. The bracket eliminates the manufacturer's expense of milling a slot in wooden drawer frames to accommodate the ends of a guide rail, and enables an end user to use existing drawers for hanging file folders where such slots were not previously provided. When desired, the brackets can be repositioned or removed by the end user with relative ease and no permanent damage or marring of the drawer surfaces.

It will be understood, of course, that various changes in the details, materials, steps and arrangement of parts, which have been herein described and illustrated in order to explain the nature of the invention, may be made by those skilled in the art within the principle and scope of the invention as expressed in the appended claims.

I claim:

1. A flush-mount bracket for use with parallel, spaced horizontal guide rails for supporting hanging file folders in a drawer, said bracket comprising:

a member including a first leg with upper and lower ends and opposite sides, one of said sides being formed for mounting on one side of a vertical panel of the drawer, a first shelf connected to the lower end of said first leg and extending perpendicularly from the other side thereof for vertically supporting an end of one of the guide rails, and a first slot in said first leg extending from said first shelf; and a pair of L-shaped members with flanges laterally extending, respectively from said first seat, in opposite directions and fixed to one of the sides of said first leg, and parallel spaced apart arms extending through said first slot adjacent respective sides of said first dot for receiving and laterally containing said end one of the guide rails therebetween.

2. A flush-mount bracket according to claim 1 further comprising a lateral section connected to the upper end of said first leg and extending perpendicularly from said one side thereof for seating on the top of the vertical panel.

3. A bracket according to claim 2 further comprising a hole in said first leg lateral section for receiving a fastener suitable for securing said bracket to the top of the vertical panel.

4. A flush-mount bracket according to claim 2 wherein said member including the first leg further comprises a second leg with upper and lower ends and opposite sides, the upper end being connected to said first leg lateral section and coextending in parallel with said first leg for engaging the corresponding opposite side of the vertical panel.

5. A flush-mount bracket according to claim 4 wherein said second leg and said flanges are spaced apart a selected distance to provide a snug fit over the oppositely corresponding sides of the vertical panel.

6. A flush-mounted bracket according to claim 4 further comprising:

a second shelf connected to the lower end of the second leg and extending perpendicularly from the lower end of one of the sides thereof in the opposite direction of said first shelf for vertically supporting an end of another of the guide rails, and a second slot in said second leg extending from said second shelf; and a pair of L-shaped members with flanges laterally extending, respectively from said second slot in opposite directions and fixed to said one side of said second leg, and parallel spaced apart arms extending through said second slot adjacent respective sides of said second slot for receiving and laterally containing the end of the other of the guide rails therebetween.

7. A flush mount bracket according to claim 6 wherein said second leg and said flanges are spaced apart a selected distance to provide a snug fit over the oppositely corresponding sides of the vertical panel.

8. A flush-mount bracket according to claim 1 wherein said flanges are spot welded to said first leg.

9. A flush-mount bracket according to claim 1 wherein said first leg having an offset portion on the one side of said first leg and said flanges form co-planar surfaces for flush mounting against the one side of the vertical panel.

10. A bracket according to claim 9 wherein said first leg includes at least one hole in said offset portion for receiving a fastener suitable for securing said bracket to the one side of the vertical panel.

11. A rod support bracket for mounting at the top of a vertical panel, comprising:

an upright section defining upper and lower ends and opposed surfaces;

a lateral section connected to the upper end of said upright section and extending from one of said surfaces for mounting on the top of the panel with said upright section against one side of the panel;

a shelf section connected to the lower end of said upright section and extending from the other surface for vertically supporting one end of the rod;

a slot in said upright section extending vertically from said shelf section; and a pair of L-shaped members with flanges respectively fixed to said one surface on either side of said slot, and parallel spaced apart upright arms extending through said slot for laterally supporting the rod end therebetween.

12. A rod support bracket for mounting on the top and sides of a vertical panel comprising:

a generally U-shaped member defining first and second legs extending in parallel from a web for straddling the top and sides of the panel, a shelf extending outwardly from the distal end of one surface of said first leg for vertically supporting an end of the rod, and a slot in said first leg extending upwardly from said shelf; and a pair of spaced apart upright members extending in parallel through said slot along said shelf for laterally supporting the rod end therebetween, said members having flanges fixed to the inside surface of said first leg and terminating near the opposite edges thereof.

13. A bracket mountable on a dividing bar for supporting respective ends of oppositely extending rods, comprising:

a U-shaped member having first and second legs extending in parallel from a web for straddling the dividing bar, each of said legs terminating in a shelf extending in opposite directions to each other for vertically supporting respective oppositely extending ends of the rod ends, and a slot through each of said legs extending upwardly from the respective shelf; and a pair of parallel spaced apart upright members extending through each of said slots along respective ones of said shelves for laterally supporting the respective rod ends therebetween, said members having flanges fixed, respectively, to the facing sides of the legs and terminating at the opposite side edges thereof.

* * * * *

UNITED STATES PATENT AND TRADEMARK OFFICE

CERTIFICATE OF CORRECTION

PATENT NO. : 5,678,797

DATED : October 21, 1997

INVENTOR(S) : James M. Gogan

Figure 3:
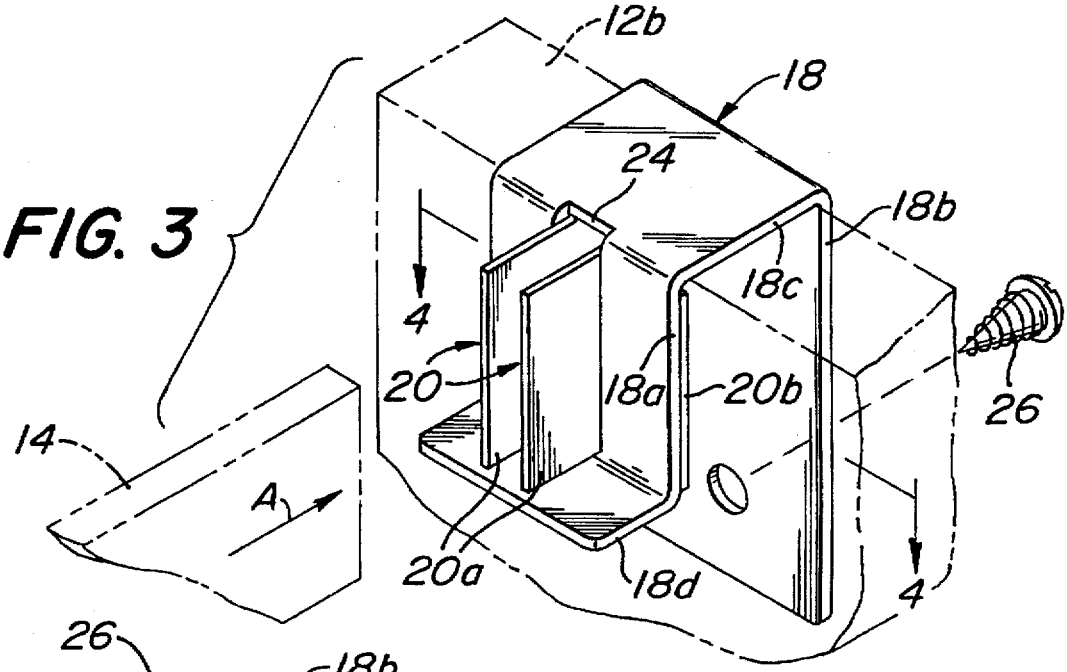
FIG. 3 is an isometric view of one of the support brackets of FIG. 1.

It is certified that error appears in the above-identified patent and that said Letters Patent is hereby corrected as shown below:

Column 2, line 31, after "is" delete the words "an isometric view of one" and insert therefor --a view in cross section", Column 2, line 37, "FIG. 3" should be changed to "FIG. 5--;

Column 2, line 47, "HE" should be changed to --THE--;

Column 4, line 62, "seat" should be changedto --slot--;

Column 4, line 65, "dot" should be changed to --slot--.

Signed and Sealed this

Twentieth Day of January, 1998

Bruce Lehman

*Attest:*

BRUCE LEHMAN

*Attesting Officer*

*Commissioner of Patents and Trademarks*